US005788807A

United States Patent [19]

Grätz

[11] Patent Number: 5,788,807

[45] Date of Patent: Aug. 4, 1998

[54] TAPE STRIPPER

[76] Inventor: Annette Grätz, Fredsgatan 39, Sala, Sweden, S-733 31

[21] Appl. No.: 894,595

[22] PCT Filed: Feb. 5, 1996

[86] PCT No.: PCT/SE96/00130

§ 371 Date: Aug. 6, 1997

§ 102(e) Date: Aug. 6, 1997

[87] PCT Pub. No.: WO96/24550

PCT Pub. Date: Aug. 15, 1996

[30] Foreign Application Priority Data

Feb. 9, 1995 [SE] Sweden ..... 9500463

[51] Int. Cl.[6] ..... B65H 35/07

[52] U.S. Cl. ..... 156/577; 156/579; 225/56; 225/65

[58] Field of Search ..... 156/574, 576, 156/577, 579; 225/39, 46, 56, 58, 57, 65

[56] References Cited

U.S. PATENT DOCUMENTS

| | | | |
|---|---|---|---|
| 3,635,473 | 1/1972 | Sasaki | 225/56 X |
| 3,970,230 | 7/1976 | Horn | 225/56 X |
| 4,957,234 | 9/1990 | Orlandini | 225/56 X |
| 5,071,051 | 12/1991 | Corbo et al. | 225/56 X |
| 5,634,580 | 6/1997 | Levy | 225/56 |

FOREIGN PATENT DOCUMENTS

| | | | |
|---|---|---|---|
| 2143505 | 2/1985 | United Kingdom | 225/56 |
| 2201946 | 9/1988 | United Kingdom | 225/65 |

*Primary Examiner*—Mark A. Osele

*Attorney, Agent, or Firm*—McGlew and Tuttle

[57] ABSTRACT

The present invention relates to a tape dispenser, preferably for large rolls of tape. It is characterized in that it comprises a rectangular platform and two legs, manufactured in one piece and designed to straddle the roll of tape. An opening is arranged for the end of the tape between a bracket secured to the dispenser and a grooved surface close to the platform, followed by a knife arranged transverse to the direction of the tape to cut the tape.

1 Claim, 3 Drawing Sheets

TAPE STRIPPER

TECHNICAL FIELD

The present invention relates to a tape dispenser, intended for all sizes of standard tape used for various applications.

1. Background Art

A problem encountered particularly with large rolls of tape is that of being unable to tape a cardboard box or the like with a tape dispenser held in the hand while at the same time tearing the tape without the need for scissors or a knife. It shall be possible to insert the tape into the dispenser in the same manner as into a normal tape dispenser for use on a table.

2. Description of the Invention

The invention aims at a solution of these and other associated problems. It consists of a rectangular platform and two legs, one leg on each side of the platform, each leg being provided with a small head to hold the tape dispenser against the roll of tape. The invention is characterized in that the dispenser comprises an opening for the end of the tape, between a bracket secured to the dispenser and a grooved surface close to the platform, followed by a knife to cut the tape. Raised portions are arranged at each end of the platform in order to prevent the tape from adhering to the platform. It is thus possible to tape a cardboard box or the like at the same time as tearing or cutting the tape, without having to reach for scissors or a special knife. It is as easy to insert the roll of tape into the device as into an ordinary tape dispenser for use on a table. The dispenser can be used commercially as well as privately for any type of tape, and this is a great step forward as regards large rolls of tape in particular. The tape dispenser is also inexpensive and can be made in any standard size for various applications. The dispenser is small, light and easily movable. An important advantage is also that it accompanies the roll when the tape is pulled. In- a preferred embodiment raised portions are arranged at each end of the platform in order to prevent the tape from adhering to the platform.

BRIEF DESCRIPTION OF THE DRAWINGS

The invention is exemplified in the accompanying drawings in which.

DESCRIPTION OF EMBODIMENT

Figure 1:
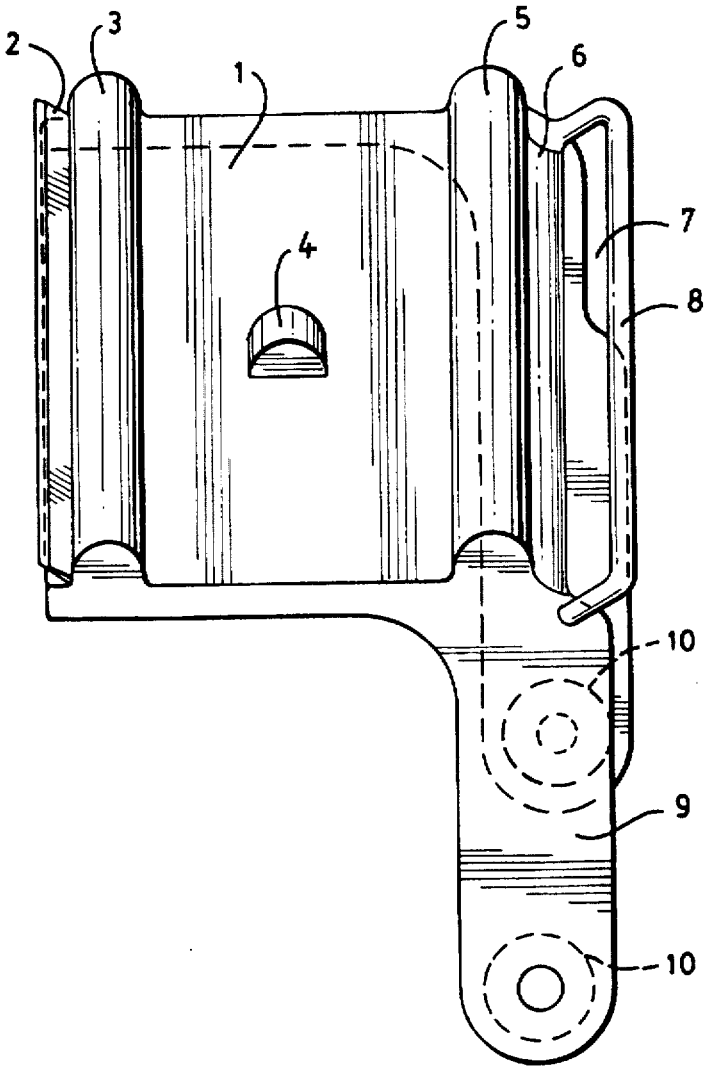
FIG. 1 shows a tape dispenser according to the invention, seen obliquely from above.

FIG. 1 shows a tape dispenser in perspective. It consists of a rectangular platform (1) with two legs (9), manufacured in one piece and designed to straddle a roll of tape (see FIG. 2). On the inner side of each of the legs (9) is a small head (10), designed to hold the dispenser to the roll of tape. On each side of the rectangle (1) is a raised portion (5, 3), arranged transverse to the direction of the tape. A small raised portion (4) is also provided on the rectangle, and a oval opening (7) through which the tape passes. This opening is arranged between a bracket (8) and a grooved surface (6) on the dispenser. Following the second raised portion (3) is a knife (2), arranged transverse to the direction of the tape to cut the tape. The rectangle (1) and raised portions (3, 5) are preferably cast in one piece.

The device functions as follows:

The roll of tape is inserted between the two legs (9) and the end of the tape is passed up through the opening (7). The tape is then placed to rest on the raised portions (3, 5) and the raised portion (4) on the upper side of the rectangle (1). The tape is then passed over the knife (2), where it is cut when a-suitable length has been drawn out. The dispenser accompanies the roll of tape as it is drawn out.

Figure 2:
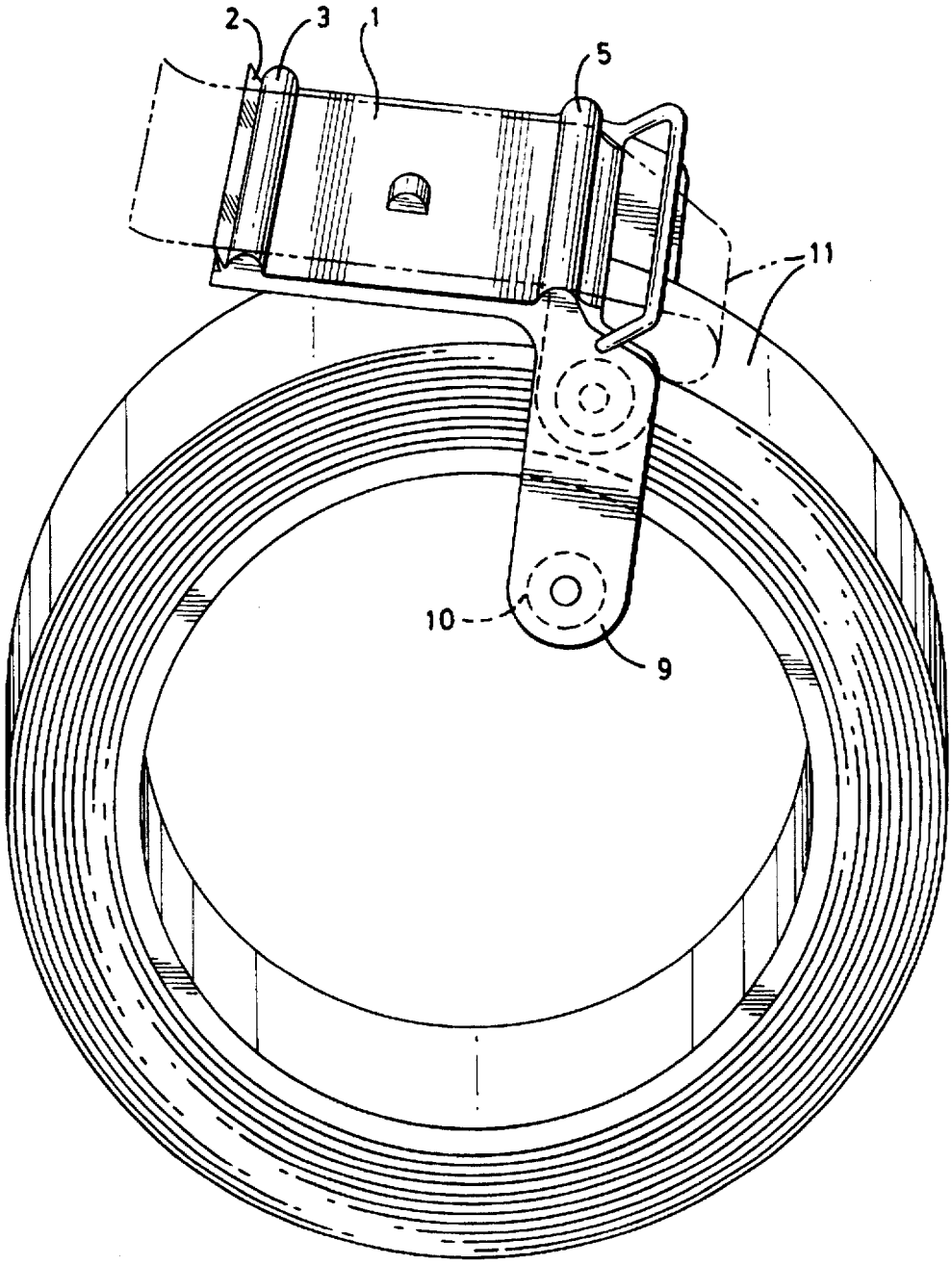
FIGS. 2 and 3 show two alternative dispensers, attached to a roll of tape.

The function of the dispenser is shown in FIG. 2 where it is applied (astride) a roll of tape (11). The three raised portions (3, 4, 5) are all designed to prevent the tape from adhering to the dispenser, i.e. to the rectangular platform (1).

Figure 3:
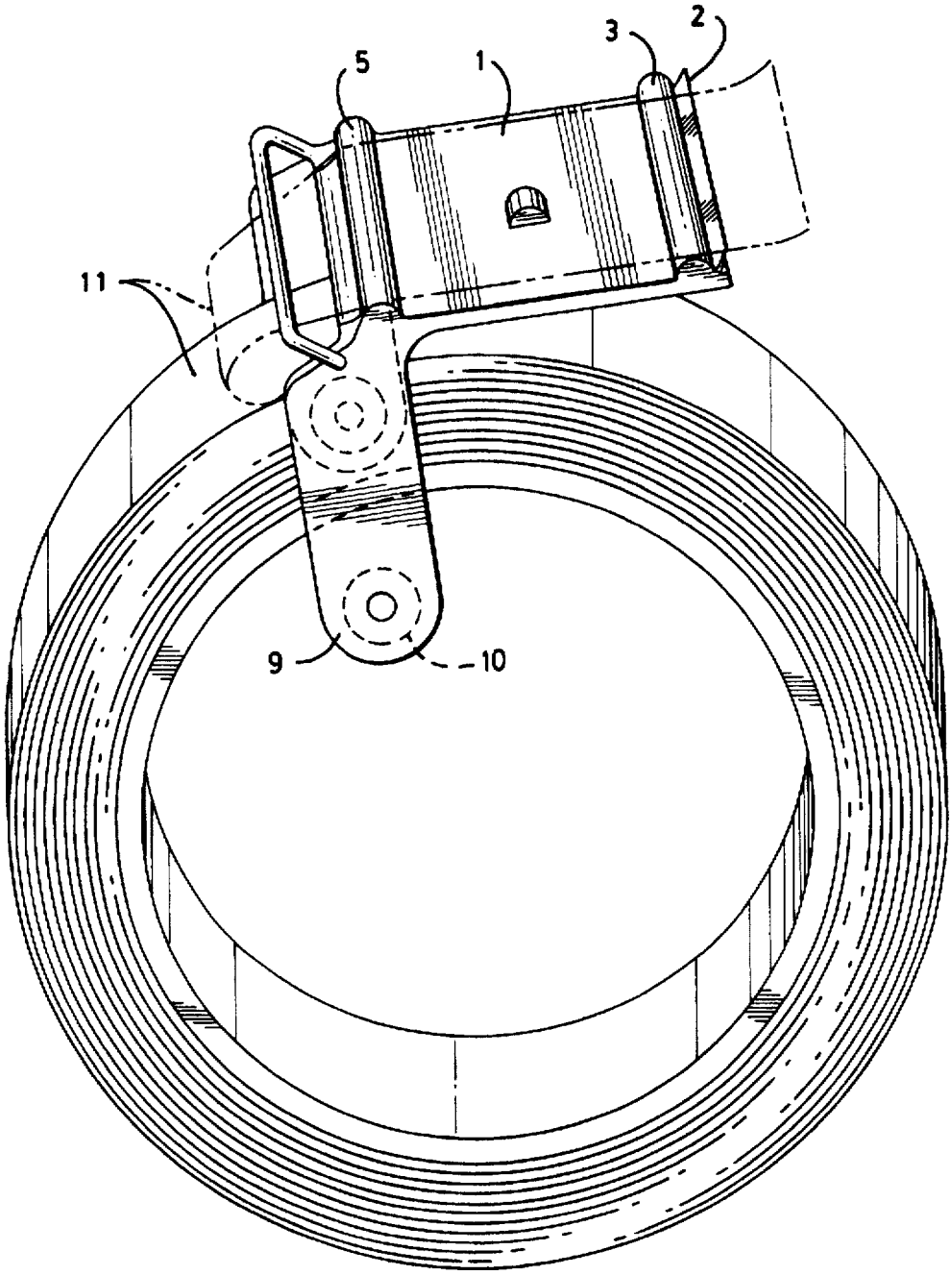

FIG. 3 shows another alternative application of the invention, particularly advantageous for left-handed users. In this case the tape (11) is first passed through the opening (7) before it passes below the dispenser and then over the raised portions (5, 3) and the platform (1) to the knife (2), where it can be cut. This embodiment clearly shows an alternative use for the dispenser in preventing the tape (11) from adhering to the platform, thanks to the raised portions (5, 3). The dispenser is of the same type as defined in FIG. 2.

The invention can be varied in many ways within the scope of the appended claims.

I claim:

1. A tape dispenser, intended for all sizes of standard tape used for various applications, consisting of a rectangular platform (1) and two legs (9), one leg on each side of the platform (1), each leg being provided with a small head (10) to hold the tape cutter against the roll of tape, characterized in that the dispenser comprises an opening (7) for the end of the tape, between a bracket (8) secured to the dispenser and a grooved surface (6) close to the platform (1), followed by a knife (2) to cut the tape, and that raised portions (3, 5) are arranged at each end of the platform (1) in order to prevent the tape from adhering to the platform (1).

* * * * *